US005965785A

United States Patent [19]

Braden et al.

[11] Patent Number: 5,965,785

[45] Date of Patent: Oct. 12, 1999

[54] AMINE BLEND NEUTRALIZERS FOR REFINERY PROCESS CORROSION

[75] Inventors: Veronica K. Braden, Sugar Land, Tex.; Paul Fearnside, Lakeville, Minn.; Christopher J. Murphy, Singapore, Singapore

[73] Assignee: Nalco/Exxon Energy Chemicals, L.P., Sugar Land, Tex.

[21] Appl. No.: 08/893,492

[22] Filed: Jul. 11, 1997

Related U.S. Application Data

[63] Continuation-in-part of application No. 08/410,475, Mar. 24, 1995, Pat. No. 5,714,664, which is a continuation-in-part of application No. 08/128,516, Sep. 28, 1993, abandoned.

[51] Int. Cl.[6] ..... C10G 7/10

[52] U.S. Cl. ..... 585/950; 208/47; 208/184; 208/186; 585/802; 585/803; 585/833

[58] Field of Search ..... 208/47, 184, 186; 585/802, 803, 833, 950

[56] References Cited

U.S. PATENT DOCUMENTS

| | | | |
|---|---|---|---|
| 3,779,905 | 12/1973 | Stedman | 208/47 |
| 4,062,764 | 12/1977 | White et al. | 208/348 |
| 4,229,284 | 10/1980 | White et al. | 208/348 |
| 4,335,072 | 6/1982 | Barnett et al. | 422/53 |
| 4,430,196 | 2/1984 | Niu | 208/47 |
| 4,599,217 | 7/1986 | Winston et al. | 422/53 |
| 4,806,229 | 2/1989 | Ferguson et al. | 208/47 |
| 4,855,035 | 8/1989 | Schutt | 208/47 |
| 5,211,840 | 5/1993 | Lehrer et al. | 208/348 |
| 5,302,253 | 4/1994 | Lessard et al. | 196/132 |
| 5,641,396 | 6/1997 | Braden et al. | 208/348 |

FOREIGN PATENT DOCUMENTS 0 512 689 A1 11/1992 European Pat. Off. .

OTHER PUBLICATIONS

"Crude Unit Overhead Corrosion Control", R. D.Merrick et al., NACE 1983, Sep. 1983, pp. 15–22.

"Cold Tower Aqueous Corrosion: Causes and Control" J. R. Rue et al., Corrosion 90, Paper No. 211, Apr. 23–27, 1990, pp. 211/1–211/16—no month available.

"Advances in Crude Unit Corrosion Control" J. R. Rue et al., Corrosion 87, Paper No. 199, (Mar. 9–13, 1987), pp. 199/1–199/25.

"Four Steps Solve Crude–Tower Overhead Corrosion Problems", Lieberman et al., Oil & Gas Journal (Jul. 5, 1993), pp. 47–50.

*Primary Examiner*—Walter D. Griffin
*Assistant Examiner*—Nadine Preisch
*Attorney, Agent, or Firm*—Michael B. Martin; Thomas M. Breininger

[57] ABSTRACT

This invention relates to inhibiting corrosion in systems of condensing hydrocarbons which contain water and chlorides, and, more particularly, in the overhead of crude oil atmospheric pipestills, with blends of amines. Preferred blends are 2-amino-1-methoxypropane, sec-butylamine, n-butylamine, dipropylamine and monoamylamine; 2-amino-1-methoxypropane, sec-butylamine, monoamylamine, n-butylamine and isobutylamine; and sec-butylamine, 2-amino-1-methoxypropane and 3-amino-1-methoxypropane.

9 Claims, 3 Drawing Sheets

AMINE BLEND NEUTRALIZERS FOR REFINERY PROCESS CORROSION

The present application is a continuation-in-part of co-pending Ser. No. 08/410,475 filed Mar. 24, 1995, U.S. Pat. No. 5,714,664, entitled "Process Using Amine Blends to Inhibit Chloride Corrosion in Wet Hydrocarbon Condensing Systems" which is a continuation-in-part of Ser. No. 08/128,516 filed Sep. 28, 1993, now abandoned entitled "Process Using Amine Blends to Inhibit Chloride Corrosion in Wet Hydrocarbon Condensing Systems", now abandoned.

FIELD OF THE INVENTION

This invention relates to inhibiting corrosion in systems of condensing hydrocarbons which contain water and chlorides, and, more particularly, in the overhead of crude oil atmospheric pipestills, with blends of amines. Preferred blends are 2-amino-1-methoxypropane, sec-butylamine, n-butylamine, dipropylamine and monoamylamine; 2-amino-1-methoxypropane, sec-butylamine, monoamylamine, n-butylamine and isobutylamine; and sec-butylamine, 2-amino-1-methoxypropane and 3-amino-1-methoxypropane.

BACKGROUND OF THE INVENTION

Crude oil refineries include an atmospheric pressure pipestill (APS) which fractionates the whole crude oil into various product fractions of different volatility, including gasoline, fuel oil, gas oil, and others. The lower boiling fractions, including naphtha, from which gasoline is derived, are recovered from the overhead fraction. The fractions with intermediate volatility are withdrawn from the tower as sidestreams. Sidestream products include kerosene, jet fuel, diesel fuel, and gas oil. The higher up on the column the sidestream is withdrawn, the more volatile the product. The heaviest components are withdrawn in the tower bottoms stream.

FIG. 1 is a simplified process flow diagram of a typical crude oil atmospheric pipestill unit. The crude is preheated in preheat exchangers against overhead product and then heated up to abut 500° F. to 700° F. in a direct-fired furnace. The feed is then flashed into the atmospheric pipestill which operates at a pressure between one and three atmospheres gauge pressure. Overhead tower temperature ranges typically from 200° F. to 350° F. FIG. 1 shows a two-stage overhead condenser system; alternative systems use one condenser stage. The overhead and sidestream products are cooled and condensed and sent to other units to be processed into final products. The bottoms stream goes to a second distillation tower (not shown) that operates under a vacuum and distills more light products out of the APS bottoms. Steam is added to the bottom of the tower to promote stripping of light products from the bottoms. Also, water is added to the top of the column to wash away soluble salts which often accumulate in the top trays and overhead components. The stripping steam and wash water coming into the system are substantial; the overhead naphtha gas stream coming off the top of the tower typically contains 20 to 40 mole % water.

The corrosion that is the subject of this invention occurs in the overhead components of the atmospheric pipestill which include the top tower trays, the piping that comes off the top of the tower and the reflux lines, the heat exchangers, the condensers and rundown lines, and the distillate drums where the condensed overhead stream is separated into liquid naphtha product and reflux. Materials commonly used in APS overhead trays and components include carbon steel, Monel 400 and 410 stainless steel. Corrosion damage can be very severe, including metal loss severe enough to cause leakage to the external environment and internal heat exchanger leaks, plugging of trays and other internals which interfere with tower operation and control and impair energy efficiency. In addition, corrosion in the APS can cause operating problems in downstream units. Because of the severity of the corrosion, even one day of uncontrolled corrosion can have serious consequences. Corrosion in the overhead exchangers is the major concern.

Corrosion in the overhead system is caused by hydrogen chloride produced by hydrolysis of chloride salts found in crude oil. Crude oils contain salts dissolved in water entrained from the production well and from saltwater picked up during tanker shipment. Generally, the chloride salts are sodium chloride, magnesium chloride, and calcium chloride. Depending on the source of the saltwater, the amount of each salt in the crude can vary considerably. Sodium chloride is stable and does not hydrolyze significantly in the atmospheric crude tower system. HCl is released when $MgCl_2$ and $CaCl_2$ are hydrolyzed by water present in crude oil:

$$MgCl_2+H_2O=2HCl=MgO$$

$$CaCl_2+H_2O=2HCl=CaO$$

The chloride salts begin to hydrolyze at temperatures in the range of 350° F. to 450° F., which occur in the preheat exchangers.

The HCl produced in the preheat system does not cause corrosion there because there is no liquid water present. The HCl, however, goes through the pipestill and passes into the overhead gas.

Temperature decreases moving up the tower and into the overhead system. At some point, temperature falls below the dewpoint temperature of the process gas and water condenses on the equipment surfaces in a thin film. This point is called the "initial condensation point" or "ICP." Water continues to condense as the process gas moves downstream and is further cooled. The overhead gas is totally condensed in the overhead condensers, is accumulated in a condensate drum, and is removed from the bottom boot of the condensate drum. Operators usually maintain the temperature at the top of the tower at least 30° F. to 40° F. above the water dewpoint to avoid corrosion in the top trays. The trend, however, is to reduce tower top temperature to improve recovery of naphtha, and this drives the dewpoint down into the tower. Accordingly, the water dewpoint usually occurs in the overhead system, but it can occur within the distillation tower if the composition of the process streams and tower operating conditions combine to raise the dewpoint above the top tower temperature. Spot or "shock condensation" can occur upstream of the ICP if there are cold spots on upstream surfaces where, for example, insulation is worn and the tower shell is exposed to cold wet weather or at cold spots on heat exchanger tubes in the condensers. Accordingly, the locations where condensation initially occurs are uncertain and changeable as operating and ambient conditions change.

The ICP and shock condensation points are important because that is where chloride concentration is highest and pH lowest. Initial condensates, if untreated, exhibit pH's as low as one or even fractional pH's, and the danger of catastrophic corrosion at these points is great. Corrosion by acidic chloride condensates is driven by the hydrogen ion concentration (pH) via the reaction:

$$Fe+2HCl=FeCl_2(soluble)+H_2$$

Hydrogen sulfide, which is formed in the pipestill from organic sulfur compounds in crude oil, also dissolves in water condensate and accelerates acidic chloride corrosion. Although the source of the corrosive attack is HCl, the product of corrosion is iron sulfide, not iron chloride. Iron sulfide is precipitated by the reaction between $H_2S$ and soluble iron chlorides from the corrosion reaction between HCl and the steel equipment, thus liberating additional HCl.

$$FeCl_2+H_2S=FeS+2HCl$$

Note that the HCl is regenerated by the $H_2S$. Hydrochloric acid thus acts as a catalyst for formation of iron sulfide, and is not consumed.

The APS streams also contain low molecular weight carboxylic acids (acetic, propionic, butyric acids) which increase corrosion at the ICP and subsequent condensation zone.

The water coming overhead from the tower is totally condensed in the overhead exchangers and is accumulated in the condensate drum. The bulk water condensate contains chlorides, sulfides, and ammonia, and is mildly corrosive. Experience indicates that bulk water condensate should be maintained in the pH range of about 5 to 6.5 to minimize corrosion in the system. pH in the bulk condensate is controlled by adding a neutralizer, such as ammonia, to the overhead system.

In addition to being subject to severe corrosion at the ICP and points of shock condensation, APS systems are also vulnerable to severe corrosion upstream of the ICP where ammonium chloride precipitates as a solid out of the gas phase onto internal surfaces. Ammonium chloride is formed in the system by the reaction between ammonia and HCl. Ammonia comes into the pipestill in the incoming crude oil and other incoming process streams, and is often intentionally added to neutralize HCl in the overhead bulk sour water condensate. At equilibrium, the partial pressure of ammonium chloride over the internal surface on which ammonium chloride has deposited equals the vapor pressure of ammonium chloride at the temperature of the internal surface. FIG. 3 is a graph of vapor pressure of ammonium chloride versus temperature. If the partial pressure of ammonium chloride above the internal surface exceeds the vapor/equilibrium pressure, then ammonium chloride will precipitate on the surface and accumulate.

Ammonium chloride deposits are hygroscopic and, when exposed to wet process gas streams flowing by, absorb moisture, forming a wet paste with a pH of about 3.5, which is a highly corrosive enviromnment. Ammonium chloride deposits are only a problem if they form above the water dewpoint. If they form below the dewpoint where water is condensing profusely along with the ammonium chloride, then the deposits will be washed away. But, if ammo nium chloride condenses above the dewpoint and water is not condensing on these surfaces, ammonium chloride deposits will not be washed away by water and the deposits will build up.

APS corrosion problems are on the increase. The increased corrosion is attributed to several causes. Salt content of crude oils now being run in refineries have increased, generating more chlorides. Also, crudes are heavier, which makes them harder to desalt. Ammonia concentrations in pipestills have risen because of refinery operating changes in other units. Also, refiners are running lower tower top temperatures to increase yields of profitable distillate fuels, such as jet fuel, and also to raise energy efficiency of the operation. Reducing top temperature often brings the water dewpoint upstream from the overhead equipment into the tower.

The first defense against overhead corrosion is crude oil desalting. A desalter is shown in the flow plan of FIG. 1. In the desalter, crude is mixed with about 5% water, which dissolves the salt. The salty water is separated from the crude and discarded. However, oil/water emulsions form that are difficult to break. Chemical demulsifiers are added to break the emulsion. Electrical devises which charge the water drops to enhance separation are also used. Up to about 90% of the salt can be removed with a single stage of water washing and separation. Salt removal effectiveness depends on the nature of the crude. Heavier oils are more difficult to desalt than light crudes. A second wash state is commonly used to remove additional salt.

Caustic (NaOH) is commonly injected into the crude downstream of the desalter to reduce chlorides in the pipestill overhead system. The caustic reacts with the magnesium and calcium chloride to form sodium chloride, which is more thermally stable and so will not hydrolyze. However, caustic treat must be limited since caustic causes furnace coking and induces operating problems in downstream units. New catalysts being used in downstream units in response to environmental control demands being imposed on refineries are poisoned by caustic. In most instances, it is impractical to remove enough salt with desalters and/or caustic addition to completely eliminate HCl corrosion. Moreover, operating upsets in the pretreat systems occur, which periodically introduce large doses of chlorides.

Accordingly, chloride neutralizers are added to the APS system to inhibit corrosion. The most common neutralizer is ammonia. It can be added as ammonia gas or as an aqueous solution usually into the overhead lines between the pipestill and the overhead condensers. ammonia is effective for increasing the pH of the overhead bulk water condensate to within a safe pH range, which is abut 5.5 to 6.5. But, ammonia does not neutralize condensate acidity at the ICP and shockpoint environs where corrosion is most virulent. This is because ammonia is volatile and ammonium chloride unstable in the water phase at ICP and shockpoint temperatures.

These concepts can be visualized by referring to FIG. 2, which is a graph of temperature versus pH of condensate for a typical APS system. The pH at the initial point of condensation which, in this example, occurs at 230° F., is below 1. pH rises to about 4 moving downstream along the curve left to right to 180° F. where the water is totally condensed. Obviously, this situation is unacceptable since the system internals will experience catastrophic corrosion at the low pH's indicated.

Curve II is for a system protected with ammonia. Note that ammonia protects the system well upstream of the zone of initial condensation, but provides no pH elevation at the virulent zone of initial condensation.

Curve III is the pH curve required to adequately protect the system. Note that the pH is uniformly elevated into the corrosion safe 5 to 6 pH range across the entire condensation zone.

Current commercial practice to protect APS units from corrosion is to inject organic amines into the APS overhead system. The amines used are volatile, so they appear in the gas phase upstream of the ICP where they react with some of the HCl in the gas stream before the HCl reaches the condensation zone. However, there may not be sufficient time and contact in the gas phase to neutralize all the HCl upstream of the condensation point. Accordingly, some of the HCl must be neutralized in the aqueous solution after it is absorbed by the condensate water phase.

Suitable neutralization amines include morpholine, methoxypropylamine, ethylenediamine, monoethanolamine, and dimethylethanolamine. APS overhead neutralizing amines are usually added as aqueous solutions, typically about 50% water. The most common injection points are in the overhead lines between the pipestill and the overhead exchangers, the sidestream inlets to the tower, and directly to the crude oil coming into the tower. Common practice is to control the neutralizer addition rate to maintain the pH of bulk water condensate in the separator drums to between 5.5 and 6.5, and preferably 5.5 to 6.0. If the proper amines are selected, adequate pH elevation is achieved over the entire condensation zone when the pH of the bulk condensate is maintained over 5.5.

Filming inhibitors are usually injected into the overhead system to further reduce corrosion in the upstream sections of the overhead system. They are proprietary formulations, usually oil soluble, which protect equipment by forming a barrier on the steel surface. Film inhibitors are effective in the downstream sections of the condencing zone where chloride concentrations are moderate, but are not effective at ICP and shock points.

A disadvantage of using amines to control corrosion in condensing systems containing chlorides is that the amines react with chlorides to form hydrochloride salts which deposit on internal surfaces. The salts deposit on surfaces at temperatures above the water dewpoint, upstream of the condensation zone, often in the top trays of the system tower. The salt deposits are hygroscopic and absorb moisture from the process gas to form highly corrosive viscous fluid or paste which induce underdeposit corrosion.

Amine salts are not a problem if they deposit in the condensation zone because they are continuously washed away by condensate. Some operators mitigate the problem by periodically washing the overhead system with water to remove deposits.

Instances of salt deposition above the dewpoint in pipestills are increasing because refineries are running heavier and dirtier crudes, which generate larger amounts of chlorides and, to protect their units, operators are increasing neutralizer amine treat rates. Ammonium chloride deposition above the dewpoint is also increasing because ammonia in crude is increasing. Accordingly, there is a need in the refining industry for new technology to inhibit corrosion in wet hydrocarbon condensing systems containing chlorides which does not compound the problem by inducing troublesome salt deposits above the dewpoint. The present invention is a novel process which accomplishes this objective.

Corrosion control in crude distillation units is discussed in two papers which were presented to the National Association of Corrosion Engineers: Rue, J. R. and Naeger, D. P., "Advances in Crude Unit Corrosion Control," Corrosion '87, Paper No. 199, National Association of Corrosion Engineers, Houston, Tex.:, and Rue, J. R., and Naeger, D. P., "Cold Tower Aqueous Corrosion: Causes and Control," Paper No. 211, National Association of Corrosion Engineers, Corrosion '90, Las Vegas, Nev. The papers discuss the amine salt deposition problem, which is the focus of the present invention, but the authors advocate techniques which minimize and suppress chloride hydrolysis to solve the problem.

The amine salt deposition problem is addressed in U.S. Pat. No. 5,211,840, which teaches that amine salt deposition can be avoided by using weak base amines, those having pKa between 5 and 8. The inventors discovered that hydrochloride salts of weak amines have less propensity to deposit on tower internals than salts of strong amines and ammonium chloride. The patent says the amines may be added to the distillation unit at any point in the overhead system prior to the location where the condensate forms.

Specifically, the patent teaches:

that it is necessary to add a sufficient amount of the neutralizing amine compound to neutralize the acidic corrosion causing species. It is desirable that the neutralizing amine be capable of raising the pH of the initial condensate to 4.0 or greater. The amount of neutralizing amine compound required to achieve this objective is an amount sufficient to maintain a concentration of between 0.1 and 1,000 ppm. based on the total overhead volume. The precise neutralizing amount will vary depending upon the concentration of chlorides or other corrosive species.

The patent also teaches:

blending a minor amount of highly basic amine with a low pka amine. These blends would be advantageous to use in systems where a sub-neutralizing quantity of highly basic amine can be used without causing above the water dewpoint corrosion and/or fouling problems.

The patent cites 4-picoline and 3-picoline as examples of low pka amines, and methoxypropylamine and ethanolamine as highly basic amines. The patent defines minor amounts to be less than 20% of treatment.

The amine salt deposition problem is addressed in U.S. Pat. No. 4,430,196, which teaches the use of a member or members selected from the group of dimethylaminoethanol and dimethylisopropanolamine.

The amine salt deposition problem is also addressed in U.S. Pat. No. 4,806,229, which teaches:

that certain amines having the following formula corresponding to Formula 1 below:

$$R—O—(CH_2)nNH_2 \qquad \text{Formula 1}$$

wherein n is 2 or 3 and R is a lower alkyl radical of not more than 4 carbon atoms, when added to a crude oil charge or at various other points in the system, effectively eliminates and/or controls corrosion that ordinarily occurs at the point of initial condensation of water vapors within or leaving the distilling unit. Illustrative of compounds falling within Formula 1 are methoxypropylamine, ethoxypropylamine, methoxyethylamine, and the like. The most preferred compound is methoxypropylamine.

State of the art techniques and equipment for injecting and controlling addition of neutralizing agents to the APS system and other refinery distillation towers are described in U.S. Pat. No. 5,302,253, which is incorporated herein by reference. In one embodiment of the disclosure, the pH of condensate removed from the tower system is continuously measured with a standard pH electrode. The pH signal is sent to a controller, which compares it with the pH setpoint, and the controller throttles the pumping rate of the amine pump used to inject neutralizer into the APS system to bring the pH of the bulk condensate reading to the setpoint. Preferably, the condensate is bulk water condensate taken from the overhead accumulator drum water boot, but condensate can be removed from some intermediate condensation point in the tower overhead system. A corrosion safe range for bulk water condensate pH is typically 5 to 6.5.

U.S. Pat. Nos. 4,335,072 and 4,599,217 describe devices which attach to the treated system and monitor corrosion rate and treatment. The devices are termed "Overhead Corrosion Simulators" ("OCS"). These patents are incorporated herein by Reference. An Overhead Corrosion Simulator is a small condenser heat exchanger cooled with flowing cooling water which is installed onto the pipestill overhead system such that it withdraws a small overhead gas slipstream from the pipestill overhead. The slipstream is withdrawn from a point sufficiently upstream where the tower temperature is above the initial point of water condensation so that no water condensation has yet occurred. The OCS cools the overhead stream in small temperature increments from initial condensation through total condensation. The condensate at each stage of cooling is continuously collected and rate of corrosion and/or pH are continually monitored using conventional instrumentation techniques. Using the OCS, corrosion rates and pH, at each point in the system where water condensation is occurring, are simulated and continually monitored and conditions at the all important point of initial condensation continually observed even if the point shifts upstream or downstream in the APS overhead system.

Various amines are known for the treatment of hydrocarbon streams. For example, a process for substantially neutralizing the volatile acid gases and water present in the condensate of a distilling petroleum product, which comprises treating the distilling product prior to the condensation thereof with at least one amine in U.S. Pat. No. 4,806,229. A corrosion control method utilizing methoxypropylamine in petrochemical process units is disclosed in U.S. Pat. No. 4,229,284. A method for neutralizing acidic components in petroleum refining units utilizing an alkoxyalkylamine is disclosed in U.S. Pat. No. 4,062,764. The use of at least one neutralizing amine for the prevention of fouling caused by amine chloride salt deposits is disclosed in U.S. Pat. No. 5,211,840. Certain amines as neutralizing agents in petroleum refining units are disclosed in U.S. Pat. No. 4,430,196 and 3,779,905. Additionally, the use of2-amino-1-methoxypropane as a neutralizing amine in refinery processes is disclosed in U.S. Pat. No. 5,641,396. Though certain amines or blends have been disclosed, there remains a need in the refining industry for new technology for more efficiently inhibiting corrosion in wet hydrocarbon condensing systems containing chlorides while not compounding the problem by inducing troublesome salt deposits above the dewpoint. The present invention represents three novel blends which accomplish this objective.

SUMMARY OF THE INVENTION

This invention relates to inhibiting corrosion in systems of condensing hydrocarbons which contain water and chlorides, and, more particularly, in the overhead of crude oil atmospheric pipestills, with blends of amines. Preferred blends are 2-amino-1-methoxypropane, sec-butylamine, n-butylamine, dipropylamine and monoamylamine; 2-amino-1-methoxypropane, sec-butylamine, monoamylamine, n-butylamine and isobutylamine; and sec-butylamine, 2-amino-1-methoxypropane and 3-amino-1-methoxypropane.

DESCRIPTION OF THE INVENTION

Figure 1:
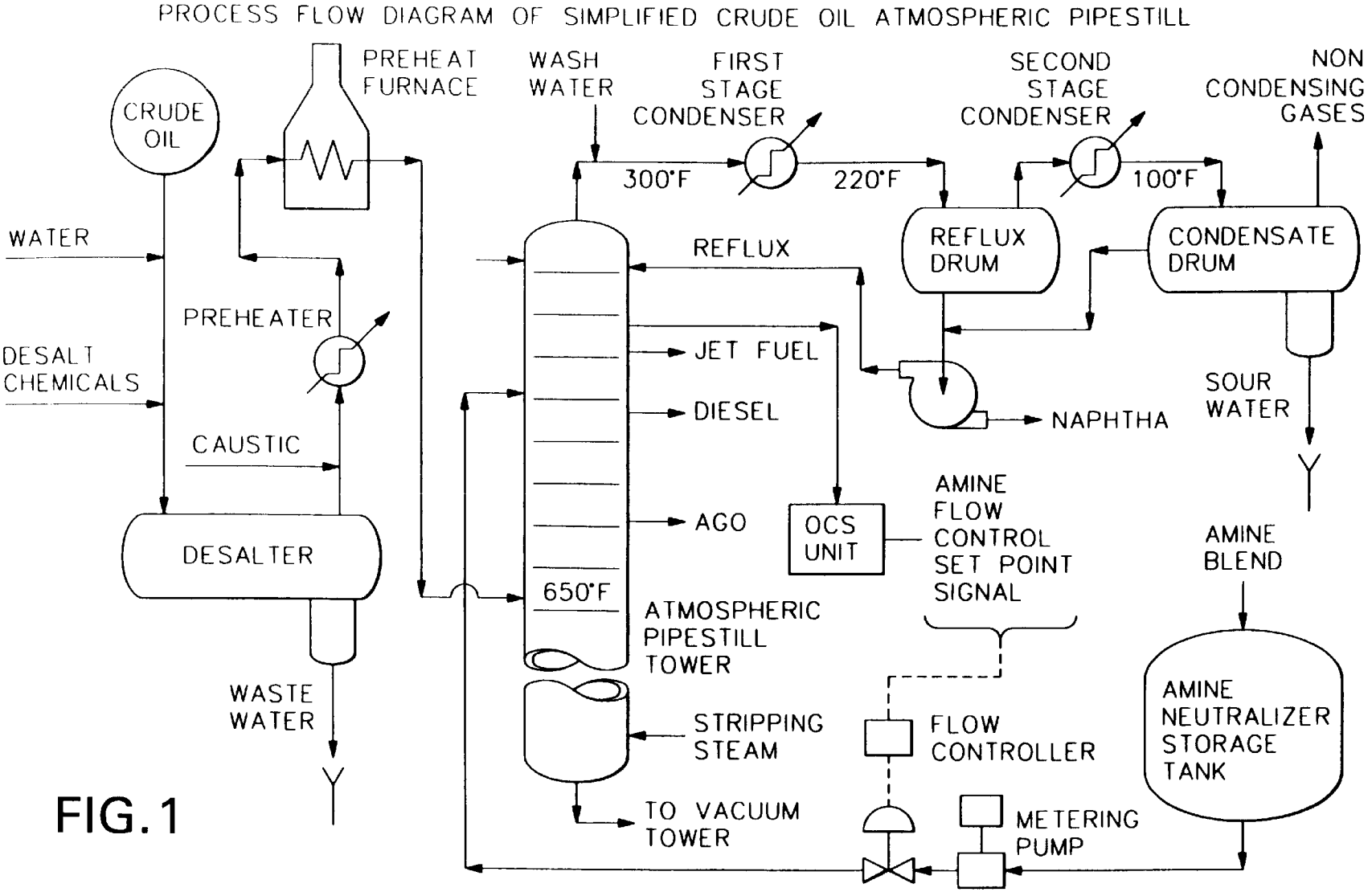
FIG. 1 is a simplified process flow diagram of a typical crude oil atmospheric pipestill unit.

The invention is a method for inhibiting corrosion on the internal metallic surfaces of a condensing system in which hydrocarbons, water, ammonium chloride and amine hydrochlorides condense, comprising:

feeding an aqueous blend of amines to the condensing system at a sufficient rate to maintain the pH of water condensate in the condensing system above a pH of about 5, wherein the amines in the aqueous blend of amines are a mixture of at least 2-amino-1-methoxypropane, sec-butylamine, n-butylamine, dipropylamine and monoamylamine.

For any aspect of this invention, an Overhead Corrosion Simulator may be utilized to monitor the pH of the condensate.

The invention is also a method of inhibiting corrosion within a pipestill during fractionation of a mixture comprising hydrocarbons, water, ammonium chloride and amine hydrochlorides wherein the pipestill has an upper condensing zone which operates at temperatures below the water dewpoint of the mixture and a lower condensing zone which operates at temperatures above the water dewpoint temperature of the mixture, the method comprising the step of:

feeding an aqueous blend of amines into the pipestill at a rate sufficient to inhibit corrosion in the upper condensing zone, wherein the amines in the aqueous blend are at least 2-amino-1-methoxypropane, sec-butylamine, n-butylamine, dipropylamine and monoamylamine.

Furthermore, the invention is also a method for inhibiting corrosion on the internal metallic surfaces of a condensing system in which hydrocarbons, water, ammonium chloride and amine hydrochlorides condense, comprising:

feeding an aqueous blend of amines to the condensing system at a sufficient rate to maintain the pH of water condensate in the condensing system above a pH of about 5, wherein the amines in the aqueous blend of amines are at least 2-amino-1-methoxypropane, sec-butylamine, monoamylamine, n-butylamine and isobutylamine.

Another aspect of this invention is a method of inhibiting corrosion within a pipestill during fractionation of a mixture comprising hydrocarbons, water, ammonium chloride and amine hydrochlorides wherein the pipestill has an upper zone which operates at temperatures below the water dewpoint of the mixture and a lower zone which operates at temperatures above the water dewpoint temperature of the mixture, the method comprising the step of:

feeding an aqueous blend of amines into the pipestill at a rate sufficient to inhibit corrosion in the upper zone, wherein the amines in the aqueous blend are at least 2-amino-1-methoxypropane, sec-butylamine, monoamylamine, n-butylamine, and isobutylamine.

This invention is also a method for inhibiting corrosion on the internal metallic surfaces of a condensing system in which hydrocarbons, water, ammonium chloride and amine hydrochlorides condense, comprising:

feeding an aqueous blend of amines to the condensing system at a sufficient rate to maintain the pH of water condensate in the condensing system above a pH of about 5, wherein the amines in the aqueous blend of amines are at least sec-butylamine, 2-amino-1-methoxypropane and 3-amino-1-methoxypropane.

Yet another aspect of this invention is a method of inhibiting corrosion within a pipestill during fractionation of a mixture comprising hydrocarbons, water, ammonium chloride and amine hydrochlorides wherein the pipestill has an upper condensing zone which operates at temperatures below the water dewpoint of the mixture and a lower condensing zone which operates at temperatures above the water dewpoint temperature of the mixture, the method comprising the step of:

feeding an aqueous blend of amines into the pipestill at a rate sufficient to inhibit corrosion in the upper condensing zone, wherein the amines in the aqueous blend are at least sec-butylamine, 2-amino-1-methoxypropane and 3-amino-1-methoxypropane.

Table 1 contains a listing of commercially available amines which were suitable candidates considered for inclusion in the neutralizer treatment blend packages of this invention, together with the key properties that affect their performance as corrosion inhibitors. Several properties and characteristics must be considered when selecting an amine for a treatment blend. The amine must be cost effective, reasonably priced per unit weight of HCl, neutralized, and should not require elaborate or expensive handling procedures to meet environmental and safety concerns. The amine must be thermally stable at temperatures it will encounter in the treated system. For APS systems, the amine must be stable up to at least 400° F. The amine must be volatile enough to be in the gas phase at conditions upstream of the condensation zone, but also condense along with water in the condensing zone. Amines with boiling points in the range of 200° F. to 300° F. usually have the requisite volatility characteristics. Also, the amine should be more soluble in water than oil.

Ideally, the melting point or sublimation temperature of the hydrochloride salt of the amine should be low relative to the temperatures in the treated system, not adhere to metal, and be readily dispersible in hydrocarbons to minimize buildup of hydrochloride salts on internals.

The amine blend is formulated to elevate pH to corrosion-safe levels across the entire condensation zone, from the point of initial water condensation, where highest chloride concentrations and lowest pH's are observed, through to the overhead condensate drums where the overhead is totally condensed and bulk sour water is accumulated, and at all intermediate water condensation points in the system. Highest treat intensity is required at the point of initial condensation.

Chlorides in APS systems have increased. Where chloride concentrations in APS bulk condensate were typically in the 30 to 50 ppm range, values as high as 600 ppm are currently being observed. Correspondingly high doses of amines must be administered to control corrosion. The amine treat rate cannot simply be increased by increasing the amine pumping rate to the treated system. The total amount of each amine in the blend must be limited so that the partial pressures of the hydrochloride salts of the amines at points upstream of the initial condensation point do not exceed partial pressure at which the salt will deposit on system internals. The required increased treat rate is achieved by increasing the number of amine species in the blend.

The treatment blend was formulated to limit the amount of each amine in the blend so that the partial pressure of the hydrochloride salt of each amine formed in the system by reaction with HCl does not exceed the partial pressure at which it will deposit from the gas phase upstream of the point of initial water condensation.

Another aspect of this current invention is that the amine neutralizer blend is formulated to contain sufficient amines with basically greater than ammonia ($K_b$>1.8×10 exp-5) to react with enough of the chlorides to bring the vapor pressure of ammonium chloride below the level where it can precipitate on internal surfaces upstream of the condensation zone. Amines that are more basic than ammonia have a higher affinity for chlorine than ammonia, so they form the amine hydrochloride in preference to ammonium chloride. Ammonium chloride deposits are undesirable because they are corrosion sites and induce pluggage operating problems.

Figure 2:
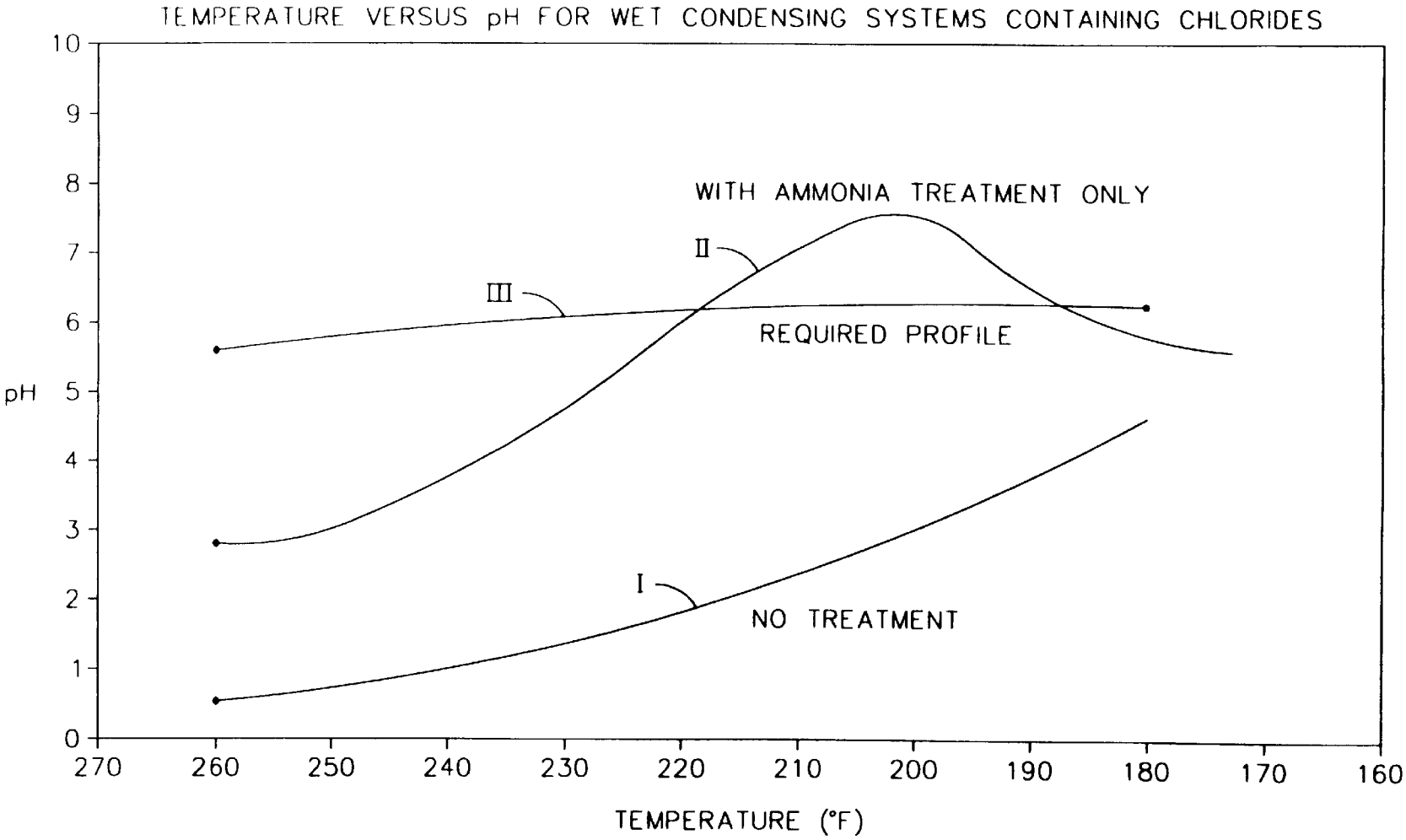
FIG. 2 contains plots of condensing zone temperature versus pH of the condensed water at that temperature. Curve I is typical of an untreated system. Curve II is representative of a system improperly treated with ammonia only. Curve III is for a system properly treated with amine neutralizers.

The amines selected have condensing and volatility characteristics close to water and are soluble in water so that they condense with and dissolve in the condensate and therefore are available to neutralize HCl absorbed by the condensate. Depending on its temperature versus its vapor/oil/water solubility partition characteristics, an amine will be very effective in one sector of the condensation zone and less effective in another. The pH versus temperature curve of FIG. 2 for a system can be moved and shaped by changing the amine formulation. Ideally, the amine mixture can be optimally custom blended to achieve the desired pH elevation to corrosion protect the system at a minimum amine treat rate.

The amine blend is custom matched to the condensation pattern by selecting at least one amine for the blend which is effective and efficient in each sector of the condensation zone. Minimizing amine treat rate by optimizing the amine blend formulation reduces the cost of the treatment, eliminates operating problems due to high amine concentrations in downstream units, and mitigates deposition of amine hydrochloride salt deposition.

Also, there is still much of what goes on in the system that is not fully understood. For example, we have observed that the hydrochloride salts of some of the amines used in amine neutralizer blend formulations have water of hydration attached to them. Depending on conditions in the tower, the number of waters of hydration associated with an amine salt may vary. The volatility of amine hydrochloride salts varies with the number of waters of hydration. Since the water of hydration associated with an amine at system operating conditions is generally not known, the limiting partial pressure to avoid salt deposition is also uncertain. Moreover, there may be interactions between amine components that affect salt deposition, particularly if dibasic amines such as ethylene diamine are used. Accordingly, candidate amine blends must be tested in a pilot distillation unit which simulates the tower system to be treated. Likely as not, the candidate formulation will have to be revised and tested several times to determine the best formula. Moreover, if subsequently the system operating conditions or the crude oil composition change, it is likely that the amine blend formula must be changed to maintain optimal corrosion control.

Developing a candidate amine blend begins with obtaining and analyzing those overhead system operating parameters which control the treatment. Operating pressure, condensing temperature, overhead gas rate, composition, and concentration of chlorides, water, ammonia and non-condensable gases in the overhead, are all required data. These parameters can be obtained by direct measurement or from simple material balances around the overhead system by conventional procedures. Most of the chlorine and ammonia formed in the system appear in the condensed water phase collected in the overhead condensate collection drums. Accordingly, chloride rate can be calculated by simple material balance, knowing the condensate rate and its chloride and ammonia concentration. Non-condensable gases are discharged usually from a vent line off the top of the condensate accumulator drums and are directly measured.

The water condensation rate and pH/chloride/corrosion rate vs temperature profiles in the tower must be obtained.

These data can most conveniently be obtained using an Overhead Corrosion Simulator installed on the tower to be protected, taken at a convenient point upstream of where water condensation begins.

The minimum theoretical or stoichiometric rate of amine addition is the number of mole equivalents of amine per minute required to stoichiometrically neutralize the HCl flowing through the tower. The actual amine addition rate to be used is 1.05 to 1.20×the stoichiometric rate, the excess added to insure complete neutralization. The base equivalents of amine required are distributed among a number of suitable amines such that none of the amine hydrochloride salts formed exhibit a partial pressure high enough for the salt to deposit on system internals upstream of the condensation zone. For purposes of this calculation, to be conservative it is assumed that all the amines form their hydrochloride salts quantitatively. Moreover, to provide a further margin of safety, it is good practice to blend the amines so that there will be no salt deposition even if temperatures in the overhead fall 50° F. below actual operating temperatures. The ideal gas law can be used to make the required calculations.

In addition, the amine blend is formulated so that sufficient amounts of amines with basicity ($K_b$'s) greater than ammonia are fed to the treated system to preclude deposition of ammonium chloride upstream of the point of initial water condensation. The molar ratio feed rate of high $K_b$ amines to ammonia should be at least 1.1.

Both the amine salt and ammonium chloride deposition computations have an inherent degree of uncertainty. Accordingly, it is good practice to test the candidate amine blend formulation in a lab unit which simulates the treated system to confirm that the candidate amine blend adequately elevates the pH vs temperature curve to corrosion-safe levels across the condensation range, that the amine blend is optimally efficient for the system being treated, and that no deposits of amine salt or ammonia form upstream of the condensation zone.

The lab unit used to simulate APS systems is a small continuous distillation tower with 20 trays, a reboiler, an overhead condenser, and a condensate collection vessel. The unit simulates the upper trays and overhead system of the treated system. The lab unit is operated at one atmosphere total pressure, whereas the APS operates at several atmospheres. However, the partial pressures of the components in the overhead system, naphtha, HCl, amines, nitrogen (to simulate non-condensable gases), and ammonia, are all maintained at the same ratios as in the APS so the simulation is valid. A naphtha is selected which matches the composition of the naphtha in the overhead stream in the treated system. For most APS units, full range naphtha is an appropriate test feed to match the gas in the overhead. Feed rates of HCl. water, ammonia, and nitrogen (to simulate non-condensable gases) to the lab unit are fixed to duplicate the partial pressures of these components in the APS system. The lab unit is made of a transparent material such as glass or plexiglas so that salt deposition in the tower can be visually observed.

A corrosion probe and thermocouple which can be moved through the unit is provided to obtain the corrosion vs temperature curve upstream of the dewpoint. a pH probe is used to measure pH of the condensate below the dewpoint.

The candidate neutralizer amine blend is injected into the lab column at a convenient point upstream of the condensation zone, typically about five trays from the top of the column.

A typical run lasts several hours, during which the pH/corrosion rate vs tower temperature profile is continually monitored across the observed water condensation zone in the tower. The amine feed rate is increased to bring the pH at the point of initial condensation in the corrosion-safe 5.0 to 6.0 pH range. The unit is checked visually for deposition of ammonium chloride and/or amine hydrochloride salts.

In APS units, the conventional method of controlling the rate of injection of amine blend into the APS is to throttle the feed rate to maintain the pH of the bulk condensate which accumulates in the water boot of the overhead condensate drum within a corrosion-safe range, typically 5 to 6. The amine pumping rate can be controlled manually or by closed-loop automation.

An alternate and preferred method of controlling the rate of addition of the neutralizer amine blend involves use of an Overhead Corrosion Simulator. Control can be accomplished manually by an operator who periodically looks at the OCS pH and/or corrosion rate profile and increases or decreases amine blend flow rate by adjusting the setpoint on the amine feed pump rate controller to maintain a corrosion-safe pH profile. The operator will pay particular attention to the point of initial water condensation where the pH is lowest and corrosion risk highest. The system can sound an alarm if pH falls or corrosion rate rises at any point if the OCS falls out of control specification. Alternatively, the control can be automated with commercially available instruments. A scanner peak picker instrument can be provided which periodically scans the pH profile in the OCS and picks out the lowest pH. The low pH signal is sent to the amine feed rate controller on the feed pump, which compares it with the setpoint. The controller adjusts amine pump feed rate to maintain the point of lowest pH at the setpoint.

The amine blend can be injected into the overhead system or into any convenient downstream point below the decomposition temperature of the amines. Preferably, the amine blend should be added as far upstream as possible away from the condensation zone to allow maximum time for the vapor phase reaction between the amines and HCl to occur. A suitable addition point for an APS unit is to the kerosene stripper return line. The amine neutralizer blend is usually administered as an aqueous solution, typically about 50% water.

The following examples are presented to describe preferred embodiments and utilities of the invention and are not meant to limit the invention unless otherwise stated in the claims appended hereto.

EXAMPLE 1

Ammonium chloride deposition was induced in lab distillation unit simulating APS overhead.

| Stream Components | Mol % | Rate |
|---|---|---|
| Naphtha (IBP-321 F; EP-352 F) | 66.26 | 70 ml/min |
| Water | 33.70 | 3.62 ml/min |
| Non-condensables | 0.004 | 5.35 cc/min |
| Ammonium hydroxide | 0.0012 | 0.028 g/min |
| HCl | 0.0012 | 0.025 g/min |

Salt deposition in the top five trays started immediately after initiation of flow of ammonium hydroxide and HCl.

Fouling quickly worked its way into the overhead condensers. The run had to be terminated after 75 minutes because the top trays were severely fouled and the column was flooding. Corrosion rates in excess of 400 mpy were recorded at locations above the water dewpoint temperature. Corrosion rates above 5 mpy are excessive.

EXAMPLE 2

The same as Example 1 except that the following amines were added five trays from the top of the column:

| Amine | Rate, moles/min |
|---|---|
| MOPA | 0.031 |
| MEA | 0.021 |

No solid salt deposition was observed either in the column or overhead condenser. The run was terminated after 4 hours, but could have gone on indefinitely. However, corrosion rates in excess of 400 mpy were again recorded above the water dewpoint temperature.

EXAMPLE 3

Same as Example 1, but only for 15 minutes, to form coating of ammonium chloride on the top column trays and in the condenser. Then the customized multi-amine blend was introduced. Not only did fouling stop, but the salt deposits in the top trays and the overhead condenser vanished over a period of about one hour. Most significantly, corrosion rate above the water dewpoint dropped to only two mpy after the salt deposits vanished.

EXAMPLE 4

This example shows one calculation procedure indicating how an amine blend for corrosion treating an APS can be formulated using the present invention:

| APS stream Component | Moles per Hour |
|---|---|
| Naphtha to overhead | 5124 |
| Water overhead | 361 |
| Chlorides overhead | 0.023 |
| Ammonia overhead | 0.020 |
| Non-condensable gases overhead | 2.8 |
| Total overhead stream | 5,488.69 |
| Operating Conditions | |
| Total pressure | 2311 mm Hg |
| Tower top temperature | 370 F. |
| Water dewpoint temperature | 230° F. |
| Total condensation temperature | 110° |

The initial estimate of equivalents of amines required to control corrosion is 10% more than the theoretical amount required to neutralize the chlorides, 1.1×0.023 chloride moles per hour rate=0.025 moles per hour of amines.

The candidate amine blend will include MOPA, MEA and morpholine. Calculate maximum moles per hour of each amine that can be fed to the system so that partial pressure of each hydrochloride salt does not exceed its dewpoint/sublimation pressure at 210° F., which is a 20° F. safety margin below the water dewpoint temperature. (The ideal gas law is applicable for these calculations.) The maximum amine rate is the total overhead flow rate 5488.69 moles per hour × vapor pressure of the amine hydrochloride at 210° F. in mm Hg divided by total system pressure, 2311 mm Hg.

| Amine Salt | VP at 210° F. | Max. amine rate | Act. Amine |
|---|---|---|---|
| MOPA-HCl | 0.008 mm Hg | 0.019 Moles/hr | 0.012 Moles/hr |
| MEA-HCl | 0.008 | 0.019 | 0.012 |
| Morph-HCl | 0.002 | 0.005 | 0.002 |
| Total | | 0.043 Moles/hr | 0.026 |

This computation indicates that if the required 0.025 moles per hour amine feed rate were satisfied with a blend of 0.012 moles/hr of MOPA, 0.012 moles per hour of MEA and 0.002 moles per hour of morpholine, there would be no deposits of the hydrochloride salt of an amine at temperatures above the water dewpoint—assuming that no anomalous effects due to association of waters of hydration with amine salts or salt interactions occurred which effect the vapor pressure of the salts. Within the constraints of maintaining the total amine flow rate at the rate required to neutralize the chlorides and not exceeding the precipitation partial pressures of the amine salts, the ratios of the amine components can be varied; and this is often done to optimize and shape the pH profile across the condensation zone.

Figure 3:
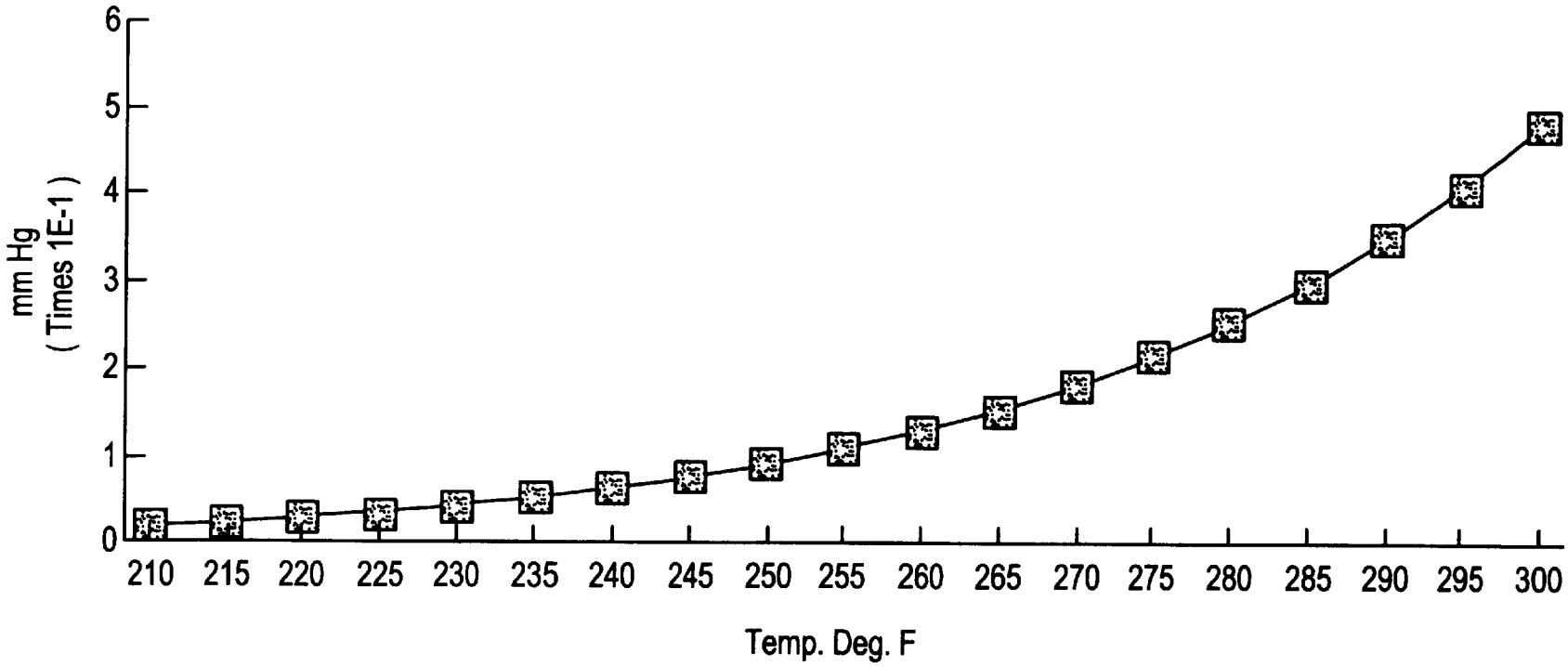
FIG. 3 is a graph of the vapor pressure of ammonium chloride versus temperature.

MOPA and MEA have $K_b$'s higher than ammonia and, since for this case the total amine 0.024 moles per hour feed rate exceeds the molar rate of chlorides coming overhead in the system, there is no risk that ammonium chloride will deposit above the water dewpoint. In the general situation, it would be assumed that amines with $K_b$'s higher than ammonia would react quantitatively with chloride and the remaining chloride would form ammonium chloride with the residual chloride. Then the partial pressure of ammonium chloride would be computed and, using FIG. 3, it would be verified that ammonium chloride would not precipitate at temperatures above the water dewpoint.

The candidate blend of MOPA, MEA and morpholine is tested in a lab APS simulation test. The pH profile across the water condensation zone is observed. The amine blend feed rate is increased until the pH profile is entirely in the corrosion safe range, above pH 5.0. The amine feed rate is compared with the theoretical stoichiometric rte required to neutralize the chlorides to determine that the excess amine ratio required is reasonable. The lab column is checked visually to verify that no amine salt deposits form. Also, corrosion probe is checked to insure that the corrosion rate is below 5 mpy. Finally, the ratio of amines in the blend is varied without exceeding the maximum amine limit of any component to determine the optimum amine blend ratio for the three component mixture which provides the required pH curve elevation at minimum total amine feed rate.

If amine salt deposits are observed upstream of the water dewpoint line using the MOPA, MEA, morpholine candidate blend, even if calculations made using vapor pressures of the hydrochloride salts indicate no deposition should occur, then it is probable that one or more of the amine hydrochlorides has less water of hydration associated with it at conditions in the system, and the less hydrated salt has significantly lower vapor pressure than the more unhydrated salt. The candidate amine mixture is reformulated with additional amine components and the new mixture tested in the APS simulation lab unit. This process is repeated until a satisfactory amine blend for the APS system to be treated is developed.

TABLE I

AMINES FOR CORROSION CONTROL

| AMINE | $K_b \times 10^5$ | Boiling Pt, ° F. | NEUTRALIZATION ON EFFICIENCY (EQUIV. WT.) | SOLUBILITY RATIO WATER/OIL | MELT PT. OF HCl SALT, ° F. |
|---|---|---|---|---|---|
| AMMONIA | 1.8 | — | 17 | >98% | 644 (sublimes) |
| MOPA | 13 | 243 | 89 | >98% | 206 |
| MEA | 32 | 338 | 60 | >98% | 170 |
| EDA | 51.5/.037 | 242 | 30 | >98% | 530 (sublimes) |
| nPA | 51 | 118 | 59 | >98% | 320 |
| MORPHOLINE | 0.21 | 262 | 89 | >98% | 350 |
| DMA | 54 | 45 | 45 | >98% | 333 |
| DMEA | 1.6 | 282 | 89 | >98% | 135 |
| DEAE | 5.2 | 322 | 117 | >98% | 270 |
| DAMP | 93/0.832 | 327 | 51 | >98% | 176 |

EXAMPLE 5

To determine the optimum blend of amines, an experimental design was conducted to minimize the number of Neutralizer Evaluation Unit (NEU) runs that are required and determine any possible interactions between the amines. The CARD™ software by S-Matrix was utilized for the experimental design. Though there are theoretically an infinite combination of amines which might be useful for corrosion control, many seemingly plausible combinations of amines cause precipitation. Since this precipitation may be due to a number of factors, and is not completely understood, experiments were performed to determine the most efficient combinations, which also did not cause precipitation in the systems of interest.

A screening mixture design was selected for this study. Eight amines were selected based on basicity, boiling point, cost and availability. These amines included 2-amino-1-methoxypropane, sec-butylamine, n-butylamine, n-ethylbutylamine, dipropylamine, n-propylamine, di-isopropylamine and amylamine.

Only single constraints were selected for the amines. A range of 0–10% was set for each amine and the diluent was fixed at a constant 50%. The software then selects the amines included in each run along with the ratio of each amine such that the amine total is always 50%. The sum of all the amines and the diluent must equal 100% for the software to function. The 50% amine is normalized to be equal to 0.05 mm Hg of chloride in the system and the concentration of each amine in the blend is calculated to afford 0.05 mm Hg of chloride in the NEU.

The screening design requires a total of eighteen amine blends. These eighteen runs include three sets of duplicates to determine experimental error. A comprehensive design was also run for comparison purposes. The comprehensive design requires a total of 63 runs with five pairs of replicates. Since each run requires a day the screening design was selected for the purpose of this study. The amine blends were prepared the same day using the same amine sample in order to minimize error from sample preparation.

The Neutralizer Evaluation Unit (NEU) was used to evaluate neutralizing amines. The NEU is a laboratory scale distillation tower constructed of glass. It consists of a 15 sieve tray Oldershaw column, a thermosiphoning reboiler, a series of overhead condensers and a condensate accumulator.

A narrow boiling naphtha was selected to simulate the desired temperature range. A Shell naphtha (R3516) with a boiler range of 316–358° F. was selected to afford an overhead temperature of 310–320° F. The NEU can simulate a tower tray or an overhead system of a condensing stream. The unit is operated at one atmosphere total pressure.

The Oldershaw sieve tower contains fifteen trays. They are numbered one to fifteen from the bottom to the top. The aqueous acid solution is heated to 400° F. and injected with a hydrocarbon slip-stream between tray 5 and 6. The aqueous neutralizer solution is heated to 370° F. and injected with a hydrocarbon slip-stream on tray 15. The NEU is under a continuous nitrogen sparge of 15 mL/min.

The acid and neutralizer concentrations and injection rates are varied to simulate a given water, acid and neutralizer partial pressure. The hydrocarbon injection rate is held constant at 34 mL/min. The hydrocarbon is injected into the reboiler which is electrically heated. It then distills up the column where it combines with the vaporized acid and the vaporized neutralizer.

An acid concentration of 0.0135N was used to achieve a 0.05 mm Hg chloride loading. The neutralizer concentration was 10–20% excess of the acid concentration fed rate. The excess neutralizer concentration is required to insure good initial dew point pH control.

Thermocouples are located in the reboiler, tray 5, 10, tray 15, the tower top, the top of the vertical condenser and the bottom of the vertical condenser. Temperatures are measured and interfaced with SCAMP, a proprietary Nalco program, to give continuous reading on a computer screen. The hydrocarbon slip-streams, acid and base are on load cells that also interface with SCAMP to give one and five minute average feed rates on a computer screen. These read-outs allow for very stable operation of the unit.

Corrosion probes are located at the top of the tower, the top of the vertical condenser and the bottom of the vertical condenser. The electrical resistance corrosion probe is a carbon steel 4 mil tubular probe. Corrosion readings are taken manually every thirty minutes.

Initial dew point is typical at the first sample well which is sampled periodically to insure good dew point neutralization. Each individual run is conducted for 6 or 7 hours to allow sufficient time for amine salt deposition and corrosion to occur and be accurately measured. After the 6 hour run is completed the unit is cooled and the corrosion probes are washed with 15 grams of deionized water.

The probe washings are analyzed for amine content. The hydrocarbon injection rate is held constant, while the water, acid and neutralizer concentrations are varied to increase or decrease the partial pressure of chloride and amine to determine the vapor pressure limits of the amine salts at a selected temperature of 240–260° F.

The following NEU conditions were used:

| | |
|---|---|
| Reboiler Hydrocarbon Feed Rate | 34 mL/min |
| Neutralizer Hydrocarbon Slip Stream | 8 mL/min |
| Acid Hydrocarbon Slip Stream | 8 mL/min |
| Aqueous Acid Feed Rate | 3.25 mL/min |
| Aqueous Neutralizer Feed Rate | 3.25 mL/min |
| Acid Injection Temperature | 400° F. |
| Neutralizer Injection Temperature | 370° F. |
| Tower Top Probe #1 Temperature | 284° F. |
| Condenser Top Probe #2 Temperature | 275° F. |
| Silicon Oil Recirculating Bath #1 | 100° F. |
| Silicon Oil Recirculating Bath #2 | 90° F. |

As a result of these experiments, it was determined that the two blends with the lowest potential to deposit amine salts are (1) a blend of 2-amino-1-methoxypropane, sec-butylamine, n-butylamine, dipropylamine and amylamine in deionized water at 18, 5, 14, 19, 17 and 27 weight percent respectively; and (2) a blend of sec-butylamine, 2-amino-1-methoxypropane, amylamine, n-butylamine and isobutylamine in deionized water at 7, 18, 18, 10, 15 and 32 weight percent respectively. Sources of the amines utilized were as follows: sec-butylamine, available from BASF in Parsippany, NJ; n-butylamine and amylamine, available from Elf Atochem in Philadelphia, PA; and 1,2 methoxypropylamine dipropylamine, n-propylamine, n-ethylbutylamine and diisopropylamine available from Air Products in Allentown, Pa.

EXAMPLE 6

The following case study is from a southern refinery that was using Product A, which is a two amine blend. They were switched to a new three amine blend, Product B, that was capable of handling the chloride loadings experienced by this refiner. After a period of time the refiner used all of Product B and returned to using Product A to substantiate the data prior to the use of Product B. Convinced that Product B was a significant and substantial improvement a permanent change was made to Product B, the new three amine blend with pKb's greater than ammonia. Corrosion rates substantially decreased when the novel amines were utilized, over the conventional treatment A as illustrated by lower corrosion readings.

TABLE II

| Product | Corrosion[1] (mpy) |
|---|---|
| A[2] | 20 |
| B[3] | 7.5 |
| A[2] | 36 |
| B[3] | 5.5 |

[1] = determined by utilizing electrical resistance probes
[2] = a mixture of 3-amino-1-methoxypropane and monoethanolamine (1/4.5 weight ratio)
[3] = a mixture of sec-butylamine, 2-amino-1-methoxypropane and 3-amino-1-methoxypropane (1.6/2/1 weight ratio of these three amines)

EXAMPLE 7

The procedure described in Example 5 was utilized to obtain the results of Table III. The efficiency of conventional treatment C for reduction of chloride salts which cause corrosion in petrochemical streams was compared to various blends of amines. Equivalent amounts of each treatment were utilized. The three and five component blends of this invention have a greatly enhanced efficiency above the conventional treatments, as evidenced by their much greater chloride capacities.

TABLE III

Chloride Handling Capabilities

| Product | Chloride Capacity |
|---|---|
| C[1] | 1 |
| D[2] | 0.8 |
| E[3] | 0.6 |
| B[4] | 2.4 |
| F[5] | 3 |
| G[6] | 3.5 |

[1] = monoethanolamine/2-amino-1-methoxypropane blend (1/1 weight ratio)
[2] = monoethanolamine/2-amino-1-methoxypropane blend (4.5/1 weight ratio)
[3] = 3-amino-1-methoxypropane
[4] = a mixture of sec-butylamine, 2-amino-1-methoxypropane and 3-amino-1-methoxypropane 1.6/2/1 weight ratio
[5] = blend of 2-amino-1-methoxypropane, sec-butylamine, amylamine, n-butylamine and dipropylamine in water at 3.6/1/2.8/3.8/3.4/5.4 weight ratios respectively
[6] = blend of 2-amino-1-methoxypropane, sec-butylamine, isobutylamine, n-butylamine and amylamine in water at 1/2.6/2.6/1.4/2/4.6 weight ratios respectively Changes can be made in the composition, operation and arrangement of the method of the present invention described herein without departing from the concept and scope of the invention as defined in the following claims:

We claim:

1. A method for inhibiting corrosion on the internal metallic surfaces of a condensing system in which hydrocarbons, water, ammonium chloride and amine hydrochlorides condense, comprising:

feeding an aqueous blend of amines to the condensing system at a sufficient rate to maintain the pH of water condensate in the condensing system above a pH of about 5, wherein the amines in the aqueous blend of amines are a mixture of at least 2-amino-1-methoxypropane, sec-butylamine, n-butylamine, dipropylamine and monoamylamine.

2. The method of claim 1, further comprising the steps of using an Overhead Corrosion Simulator to monitor the pH of the condensate.

3. A method of inhibiting corrosion within a pipestill during fractionation of a mixture comprising hydrocarbons, water, ammonium chloride and amine hydrochlorides wherein the pipestill has an upper condensing zone which operates at temperatures below the water dewpoint of the mixture and a lower condensing zone which operates at temperatures above the water dewpoint temperature of the mixture, the method comprising the step of:

feeding an aqueous blend of amines into the pipestill at a rate sufficient to inhibit corrosion in the upper condensing zone, wherein the amines in the aqueous blend are at least 2-amino-1-methoxypropane, sec-butylamine, n-butylamine, dipropylamine and monoamylamine.

4. A method for inhibiting corrosion on the internal metallic surfaces of a condensing system in which hydrocarbons, water, ammonium chloride and amine hydrochlorides condense, comprising:

feeding an aqueous blend of amines to the condensing system at a sufficient rate to maintain the pH of water condensate in the condensing system above a pH of about 5, wherein the amines in the aqueous blend of amines are at least 2-amino-1-methoxypropane, sec-butylamine, monoamylamine, n-butylamine and isobutylamine.

5. The method of claim 4, further comprising the steps of using an Overhead Corrosion Simulator to monitor the pH of the condensate.

6. A method of inhibiting corrosion within a pipestill during fractionation of a mixture comprising hydrocarbons, water, ammonium chloride and amine hydrochlorides wherein the pipestill has an upper zone which operates at temperatures below the water dewpoint of the mixture and a lower zone which operates at temperatures above the water dewpoint temperature of the mixture, the method comprising the step of:

feeding an aqueous blend of amines into the pipestill at a rate sufficient to inhibit corrosion in the upper zone, wherein the amines in the aqueous blend are at least 2-amino-1-methoxypropane, sec-butylamine, monoamylamine, n-butylamine, and isobutylamine.

7. A method for inhibiting corrosion on the internal metallic surfaces of a condensing system in which hydrocarbons, water, ammonium chloride and amine hydrochlorides condense, comprising:

feeding an aqueous blend of amines to the condensing system at a sufficient rate to maintain the pH of water condensate in the condensing system above a pH of about 5, wherein the amines in the aqueous blend of amines are at least sec-butylamine, 2-amino-1-methoxypropane and 3-amino-1-methoxypropane.

8. The method of claim 7, further comprising the steps of using an Overhead Corrosion Simulator to monitor the pH of the condensate.

9. A method of inhibiting corrosion within a pipestill during fractionation of a mixture comprising hydrocarbons, water, ammonium chloride and amine hydrochlorides wherein the pipestill has an upper condensing zone which operates at temperatures below the water dewpoint of the mixture and a lower condensing zone which operates at temperatures above the water dewpoint temperature of the mixture, the method comprising the step of:

feeding an aqueous blend of amines into the pipestill at a rate sufficient to inhibit corrosion in the upper condensing zone, wherein the amines in the aqueous blend are at least sec-butylamine, 2-amino-1-methoxypropane and 3-amino-1-methoxypropane.

* * * * *